US007451526B2

(12) United States Patent
Duda et al.

(10) Patent No.: US 7,451,526 B2
(45) Date of Patent: Nov. 18, 2008

(54) APPARATUS FOR CONSOLIDATING A CONVEYABLE FIBRE WEB, FOR EXAMPLE OF COTTON, SYNTHETIC FIBRES OR THE LIKE

(75) Inventors: Günter Duda, Mönchengladbach (DE); Gregor Eschenbruch, Mönchengladbach (DE)

(73) Assignee: Trutzschler GmbH & Co. KG, Monchengladbach (DE)

( * ) Notice: Subject to any disclaimer, the term of this patent is extended or adjusted under 35 U.S.C. 154(b) by 649 days.

(21) Appl. No.: 11/106,499

(22) Filed: Apr. 15, 2005

(65) Prior Publication Data

US 2006/0010653 A1 Jan. 19, 2006

(30) Foreign Application Priority Data

Apr. 21, 2004 (DE) ..... 10 2004 019 912
Dec. 9, 2004 (DE) ..... 10 2004 059 257
Feb. 10, 2005 (DE) ..... 10 2005 006 273

(51) Int. Cl.
*D01H 5/32* (2006.01)

(52) U.S. Cl. ..... 19/240; 19/260; 19/98

(58) Field of Classification Search ..... 19/239, 19/240, 260, 98
See application file for complete search history.

(56) References Cited

U.S. PATENT DOCUMENTS 4,512,061 A * 4/1985 Hartmannsgruber et al. .. 19/239
5,161,284 A * 11/1992 Leifeld ..... 19/260
5,761,772 A * 6/1998 Clapp et al. ..... 19/260
5,774,940 A * 7/1998 Clapp et al. ..... 19/159 R
5,774,942 A * 7/1998 Clapp et al. ..... 19/239
5,774,943 A 7/1998 Clapp et al.
6,286,188 B1 * 9/2001 Muller et al. ..... 19/239
6,336,256 B1 * 1/2002 Naf et al. ..... 19/65 A
6,453,513 B2 * 9/2002 Duda ..... 19/236
6,453,514 B1 * 9/2002 Breuer et al. ..... 19/239
6,499,194 B1 * 12/2002 Gresser et al. ..... 19/239
6,640,392 B2 * 11/2003 Cherif et al. ..... 19/236

FOREIGN PATENT DOCUMENTS

BE 856846 A4 10/1977
DE 2749849 A1 5/1978
DE 197 13 255 A1 10/1998
DE 198 23 805 A1 3/1999
DE 101 56 734 A1 5/2003
DE 103 27 469 A1 1/2004

OTHER PUBLICATIONS

German Search Report in German Applicatin No. 10 2004 019 912.4, dated Nov. 26, 2004.

* cited by examiner

*Primary Examiner*—Shaun R Hurley
(74) *Attorney, Agent, or Firm*—Venable LLP; Robert Kinberg

(57) ABSTRACT

In an apparatus for consolidating a conveyable fibre web, for example of cotton, synthetic fibers or the like, there is provided, at the exit from a flat card, roller card or the like, a web funnel together with take-off rollers, the outlet region of the web funnel has a substantially rectangular cross-section, and an endlessly revolving consolidating device, for example comprising two rollers, is provided downstream of the web funnel. In order to improve the apparatus for consolidation, the consolidating device comprises at least two roller pairs arranged one behind the other, which are biased by a force and the speed of rotation of which can be controlled.

39 Claims, 7 Drawing Sheets

1
2
3a
3b
3c
4
5
6
7
8
10
11
12
13
14
A

APPARATUS FOR CONSOLIDATING A CONVEYABLE FIBRE WEB, FOR EXAMPLE OF COTTON, SYNTHETIC FIBRES OR THE LIKE

CROSS REFERENCE TO RELATED APPLICATION

The present application claims priority from German Patent Application Nos. 10 2004 019 912.4 dated Apr. 21, 2004, and 10 2004 059 257.8 dated Dec. 9, 2004, the entire disclosure of each of which is incorporated herein by reference. The present application also claims priority from German Patent Application No. 10 2005 006 273.3 dated Feb. 10, 2005.

BACKGROUND OF THE INVENTION

The invention relates to an apparatus for consolidating a conveyable fibre web, for example of cotton, synthetic fibers or the like. It is known to provide at the exit from a carding machine, in particular a flat card, roller card or the like, a web funnel together with take-off rollers, the outlet region of the web funnel having a substantially rectangular cross-section, with there being provided downstream of the web funnel an endlessly revolving consolidating device, for example comprising two rollers, between which the fibre web passes.

In a known apparatus (DE-A-101 56 734), two surface-shaped rollers, which convey the fibre material onwards and consolidate it, are arranged downstream of the take-off rollers.

It is an aim of the invention to provide an improved apparatus for consolidating a conveyable fibre web, for example of cotton, synthetic fibers or the like.

SUMMARY OF THE INVENTION

The invention provides an apparatus for consolidating a conveyable fibre web in a carding machine, comprising:

a web funnel for receiving a web of fibre material;

a consolidating device downstream of the web funnel wherein:

the consolidating device comprises at least two roller pairs arranged one behind the other, each pair of rollers being biased; and there is at least some control of the speed of rotation of the rollers.

The measures according to the invention make it possible to produce a substantially more uniform fibre web. In particular, short-periodicity irregularities, which can result in weight variations in the end product, are effectively evened out. In addition, the strength of the web strips can be advantageously increased.

It is preferred for the consolidating device to be in the form of a drawing mechanism. Advantageously, the drawing mechanism is a 3-over-3 drawing mechanism. The drawing mechanism may be arranged spaced away from the take-off rollers. The take-off rollers may be the intake roller pair of the drawing mechanism. Advantageously, the upper rollers of the drawing mechanism are biased by a force. Preferably, the upper rollers are urged against the lower rollers by means of biased pressure elements in pressure arms. In one advantageous embodiment, two pressure elements having a common holding element are associated with each upper roller. The pressure elements may be, for example, pneumatic cylinders or compression springs. Advantageously, the biasing device can be brought into and out of play. Advantageously there is associated with the drawing mechanism a regulating device, which has a measuring device for the mass of the fibre web, an electronic control device and an actuating device. The measuring device may be associated with the take-off rollers. In that case, a take-off roller may be biased, for example, by a spring. The measuring device may be any suitable measuring device, for example, a displacement sensor; an inductive sensor, for example, an inductive displacement transducer; a capacitive sensor; or a microwave sensor. In certain preferred embodiments a plurality of measuring devices are provided. There may be a measuring device arranged in one or more of the following regions: between take-off rollers and the entrance to the drawing mechanism; between two roller pairs of the drawing mechanism; and associated with at least one upper roller of the drawing mechanism. The actuating device may be, for example, a controlled motor for driving at least one roller pair of the drawing mechanism.

In certain preferred embodiments, the intake and middle roller pairs are arranged to be driven by a controlled motor. The delivery roller pair may be arranged to be driven by a main motor. Each roller pair may be arranged to be driven by a drive motor. In certain preferred embodiments the intake and middle roller pairs are each arranged to be driven by a controlled motor. Advantageously, the controlled motors are capable of modifying the drafting between the roller pairs of the drawing mechanism.

A desired value setter may be connected to the electronic control device. One or more controlled motors for the drawing mechanism and the drive motors for the carding machine may advantageously be connected to a common electronic control and regulation device. Advantageously, the speed of rotation of at least one roller pair is subject to closed-loop control.

Preferably, a web-guiding device is arranged between the take-off rollers and the drawing mechanism intake rollers. The web-guiding means may comprise two endlessly revolving conveyor belts co-operating with one another. Advantageously, the course of the conveyor belts is curved. Advantageously, the web-guiding means is capable of diverting the fibre web from the take-off rollers to the drawing mechanism. Advantageously, the web-guiding device is capable of diverting the fibre web from a substantially vertical direction to a horizontal or sloping direction.

It is instead possible for the fibre web emerging from the take-off rollers continuously to run into the intake roller pair of the consolidating device, for example, the drawing mechanism. Advantageously, at least two flat cards, roller cards or the like are provided upstream of the consolidating device. Advantageously, at least two web strips are brought together and introduced into the consolidating device. Advantageously, at least two web strips are arranged one above the other. Advantageously, a device for bringing together the at least two web strips and positioning them one above the other is provided between the at least two flat cards, roller cards or the like and the consolidating device. Advantageously, at least two measuring elements (sensors) are provided. Advantageously, a measuring element is arranged between the roller pairs of the drawing mechanism. Advantageously, at least one measuring element is associated with the upper rollers of the drawing mechanism. Advantageously, at least one pressure rod is provided in the main drafting zone.

The invention also provides an apparatus for consolidating a conveyable fibre web, for example of cotton, synthetic fibers or the like, wherein a web funnel together with take-off rollers is provided at the exit from a flat card, roller card or the like, the outlet region of the web funnel has a substantially rectangular cross-section, and an endlessly revolving consolidating device, for example, comprising two rollers, between which the fibre web passes, is provided downstream of the web funnel, characterized in that the consolidating device comprises at least two roller pairs arranged one behind the other, which are biased by a force and the speed of rotation of which can be controlled at least in part.

Moreover, the invention provides a method of consolidating a textile fibre web, comprising continuously collecting a fibre web delivered by a carding machine, compressing the fibre web, and passing the compressed fibre web through a consolidating device having at least two pairs of rollers arranged one behind the other, wherein there is at least some control of speed of rotation of the rollers.

DESCRIPTION OF PREFERRED EMBODIMENTS

Figure 1:
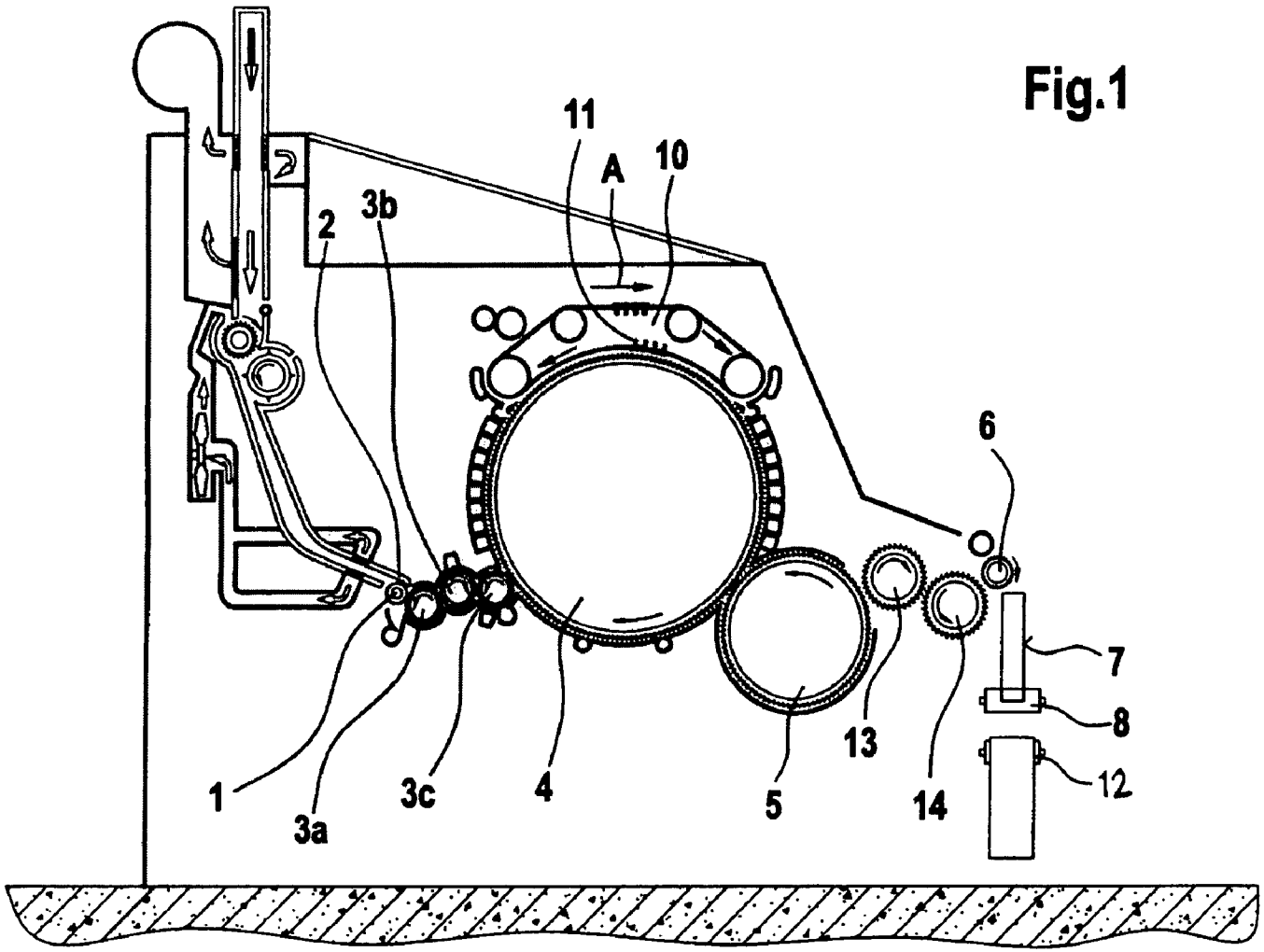
FIG. 1 is a diagrammatic side view of a carding machine for the apparatus according to the invention.

Except where the contrary is indicated, reference numerals used in any figure of the drawings have the same meaning as in any other figure in which they are used.

FIG. 1 shows a carding machine, for example, a TC 03 carding machine made by Trützschler GmbH & Co. KG of Mönchengladbach, Germany, having a feed roller 1, feed table 2, lickers-in 3*a*, 3*b*, 3*c*, cylinder 4, doffer 5, stripper roller 6, web-collecting element 7, take-off rollers 8, 9 and revolving card top 10 having slowly revolving card top bars 11. Curved arrows indicate the directions of rotation of the rollers of the carding machine. Reference letter A denotes the work direction (direction of flow of fibre material). Arranged between the doffer 5 and the stripper roller 6 are two compression rollers 13, 14, which collect the fibre material in order to form a heavy web. The stripper roller 6 rotates in a clockwise direction and drops the fibre material into the web-collecting element 7 from above. The web-collecting element 7 is of funnel-shaped construction (see FIG. 3) and is arranged vertically. At the lower end of the web-collecting element 7 are the two take-off rollers 8, 9 (see FIG. 3), downstream of which and below which there is arranged a web-guiding device 15 (see FIG. 3).

Figure 2:
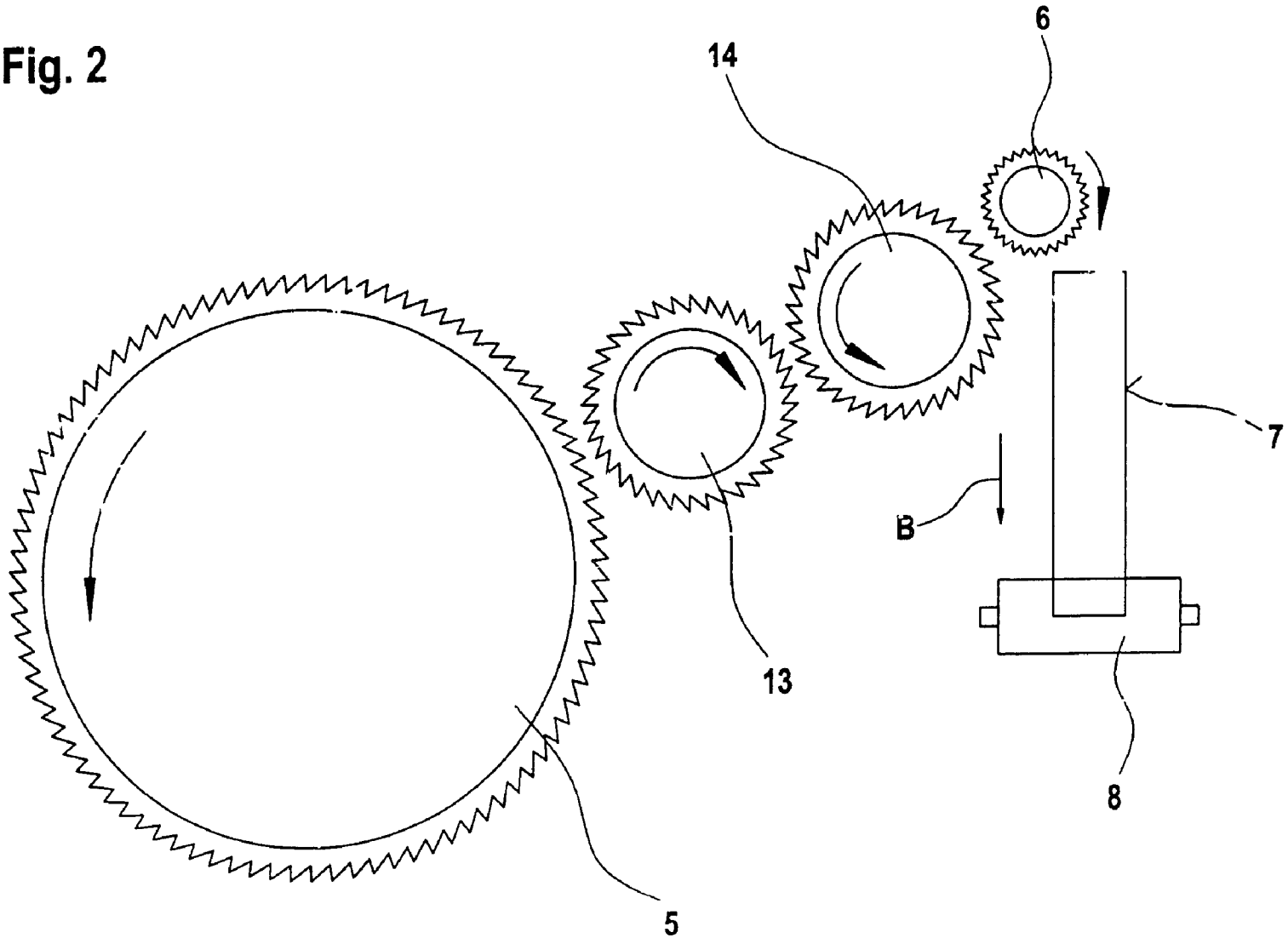
FIG. 2 is a side view of the exit from the carding machine according to FIG. 1, with two ascending compression rollers.

In accordance with FIG. 2, the compression rollers 13 and 14, which are arranged downstream of the doffer 5, and the stripper roller 6 are in an ascending arrangement. The fibre material is, as a result, raised to a certain height. As a result, the web-collecting element 7 can be arranged below the stripper roller 6 so that the delivered fibre web material drops down into the web-collecting element 7 assisted by gravity, which aids the flow of material. The take-off rollers 8, 9 take off the compressed fibre sliver 16 from the outlet aperture of the web-collecting element 7.

Figure 3:
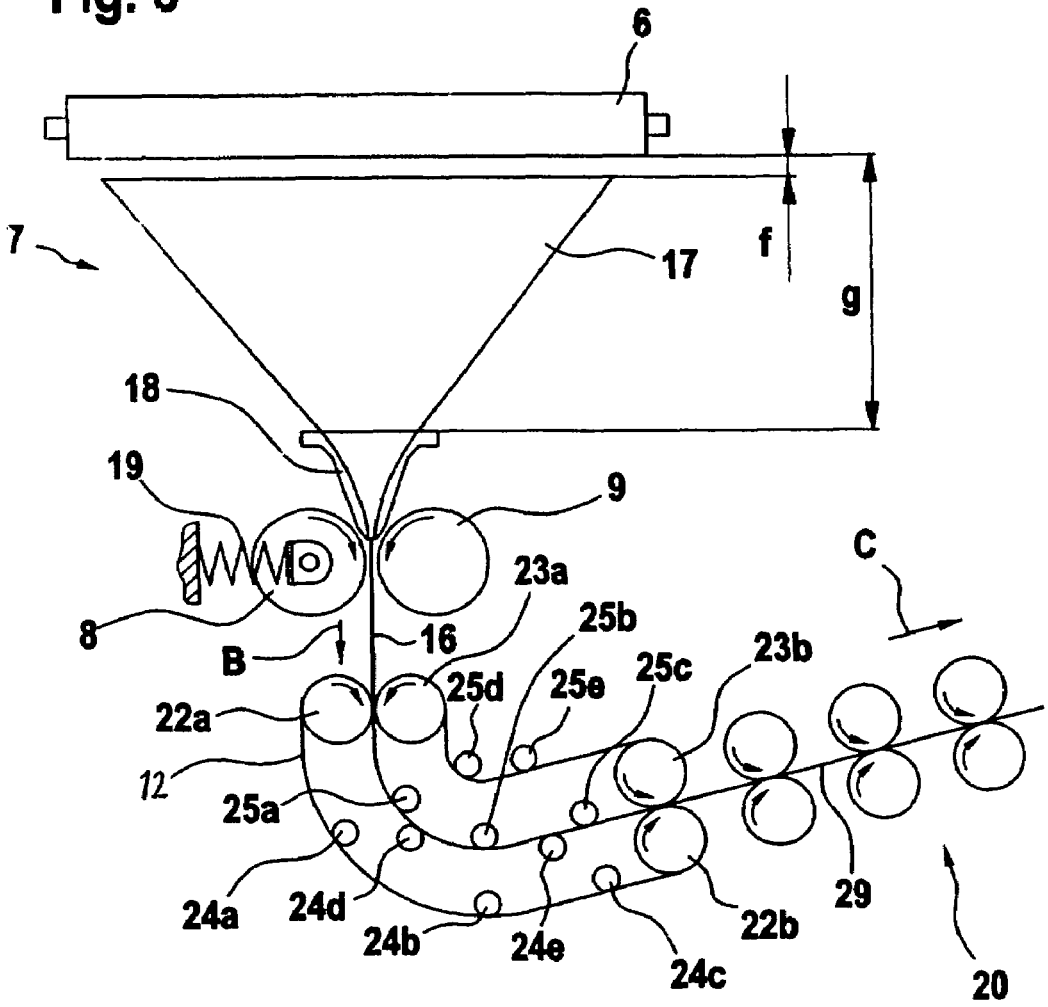
FIG. 3 is a front view of the outlet from the carding machine according to FIG. 1, with a web-guiding device provided downstream of the take-off rollers.

In accordance with FIG. 3, the web-collecting element 7 has, seen in the direction of flow of fibre material, a web-collecting region and a web compression region. In accordance with FIG. 3, the web-collecting element 7 consists of a web-guiding element 17, which forms the web-collecting region, and a web funnel 18, which forms the web compression region. The web-guiding element 17 and web funnel 18 are enclosed on all sides, except for the respective inlet and outlet apertures for the fibre material. The inlet aperture of the web-guiding element 17 is arranged spaced away from the stripper roller 6 at a distance f, for example about 50 mm. The web-guiding device 15, which conveys the fibre material onwards and consolidates it, is arranged downstream of and below the take-off rollers 8, 9 (roller 8 is biased by a spring 19). The axes of the take-off rollers 8, 9 and the rollers of the web-guiding device 15 are oriented parallel to one another. The wide side (corresponding to a in FIG. 4) of the fibre sliver emerging from the funnel 18 passes through the nip between the rollers 8, 9.

The web-guiding device 15 consists of two co-operating conveyor belts 12, 21, which endlessly revolve around return rollers 22*a*, 22*b* and 23*a*, 23*b*, respectively. Associated with the conveyor belts 12, 21 are supporting and guiding rollers 24*a* to 24*e* and 25*a* to 25*e*, respectively. The strip-shaped web 16, which is conveyed forwards between the two conveyor belts 12, 21, is conveyed by the web guide 15 from the vertical direction B into a direction C ascending at an angle. The return rollers 22*a*, 22*b*, 23*a*, 23*b* and the supporting and guiding rollers 24*a* to 24*e*, 25*a* to 25*e* are driven by drive devices (not shown), for example drive motors.

Figure 5:
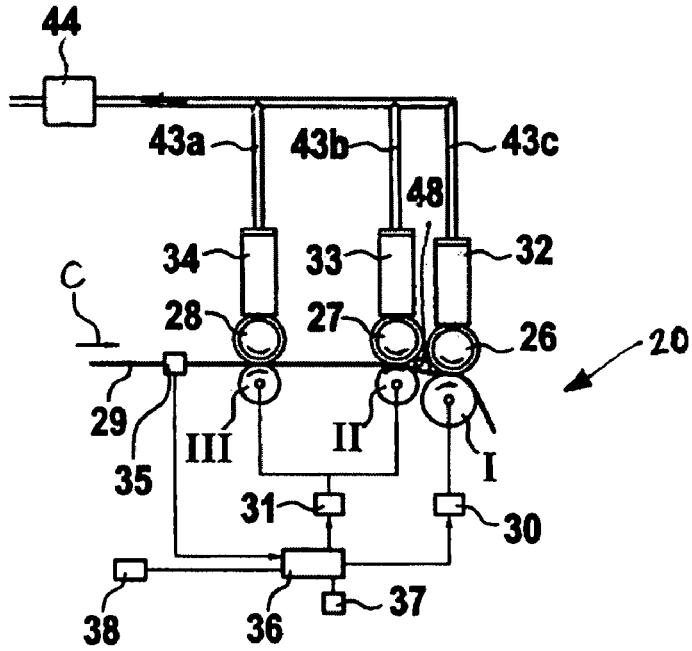
FIG. 5 is a diagrammatic side view of a consolidating device in the form of a pneumatically biased drawing mechanism and a generalized circuit diagram of a first arrangement of a control device.

Downstream of the web-guiding device 15 there is provided a consolidating device in the form of a drawing mechanism 20 having three pairs of rollers arranged one behind the other in direction C, which drawing mechanism is shown in FIG. 5 and described in greater detail hereinbelow with reference to FIG. 5.

Figure 4:
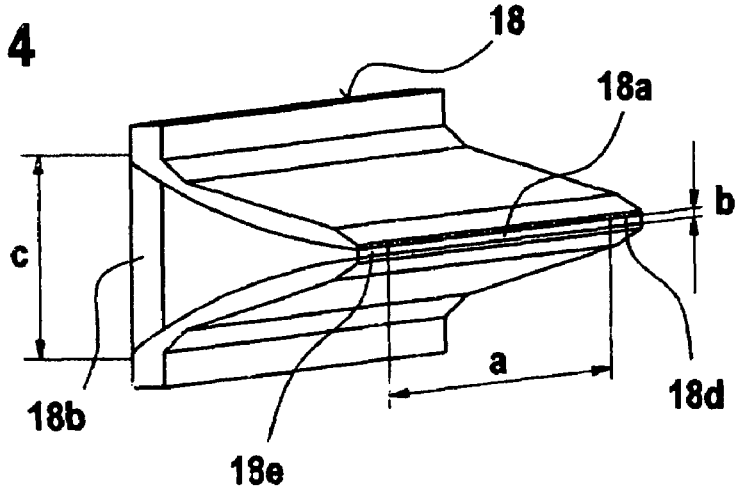
FIG. 4 is a perspective view of a fibre material funnel having a rectangular outlet region.

In accordance with FIG. 4, the outlet aperture 18*a* of the web funnel 18 has a height b of about 2 to 3 mm. An inlet aperture of the web funnel 18 has a height c. The width a of the outlet aperture 18*a* of the web funnel 18 is at least about 30 to 100 mm. For example, the outlet may have dimensions of about 2 by 30 mm. The width a can be modified by means of the fact that a wall element 18*b* in the region of the outlet aperture 18*a* can be displaced to obscure, for example, regions 18*d* and 18*e* of outlet aperture 18*a*. The rectangular region 18*a* is formed with sharp edges. By that means, the flat fibre sliver 16 emerging from the web funnel has a shape of sharp-edged cross-section.

In accordance with FIG. 5, there is provided the drawing mechanism 20, which is designed as a 3-over-3 drawing mechanism, that is to say it consists of three lower rollers I, II, III (I delivery lower roller, II middle lower roller, III intake lower roller) and three upper rollers 26, 27, 28. Drafting of the fibre sliver 29 is carried out in the drawing mechanism 20. Drafting is composed of preliminary drafting and main drafting. The roller pairs 28/III and 27/II form the preliminary draft zone and the roller pair 26/I forms the main draft zone. The delivery lower roller I is driven by the main motor 30 and accordingly governs the delivery speed. The intake and middle lower rollers, respectively III and II, are driven by a controlled motor 31. The upper rollers 26 to 28 are urged against the lower rollers I, II, III by pneumatic pressure elements 32 to 34 (biasing device) in push arms, which can pivot about rotary mountings, and accordingly obtain their drive by means of a frictional connection. Curved arrows indicate the directions of rotation of rollers I, II, III; 26, 27, 28. The fibre sliver 29, which consists of a web strip, runs in direction C between the roller pairs 28/III, 27/II and 26/I and in the process is drafted and consolidated. As a result of the increasing circumferential speed of the roller pairs 28/III, 27/II and 26/I in direction C, the fibre web 29 is consolidated. In the main drafting zone there is provided a pressure rod 48.

At the entrance to the drawing mechanism 20, that is to say upstream of the roller pair 28/III and downstream of the exit from the web guide 15 located upstream, there is arranged a measuring device 35, for example a microwave measuring arrangement, which registers variations in the mass of the fibre web 29. The measuring element 35 is connected to an electronic control and regulation device 36 having a desired value memory 37 and is in communication with a control and regulation device 38, by means of which the upstream carding machine and the web guide 15 are controlled and regulated. The electronic control and regulation device 36 is furthermore in communication with the drive motors 30 and 31. Reference numerals 43*a* to 43*c* denote pneumatic lines and reference numeral 44 denotes a source of compressed air.

Figure 6:
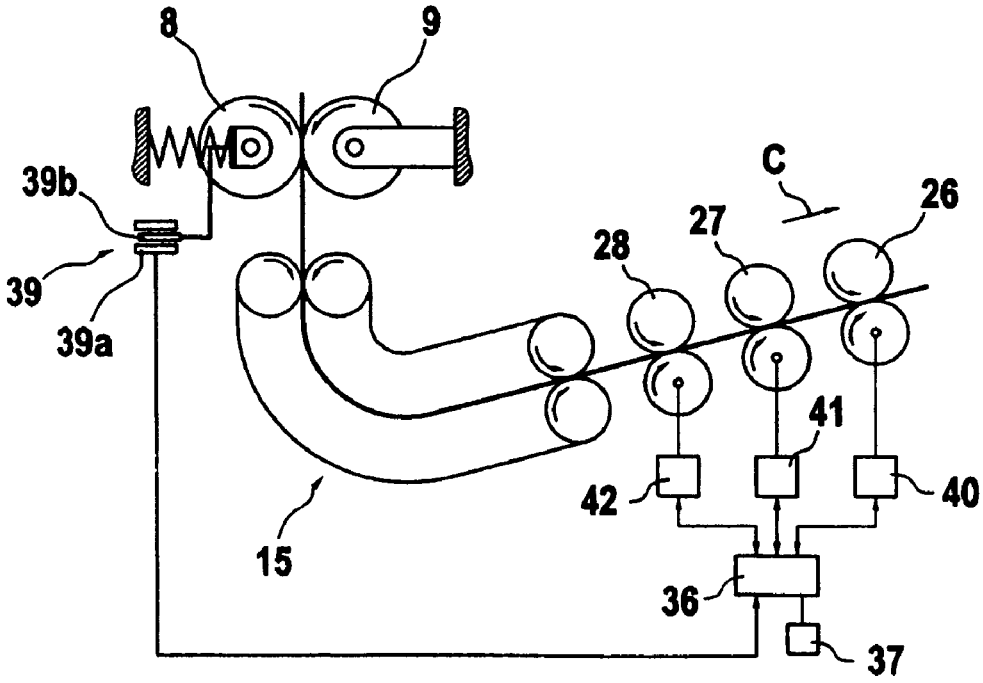
FIG. 6 shows a side view of the drawing mechanism together with a second arrangement of control device.

Another embodiment of the consolidation apparatus is shown in FIG. 6. An inductive displacement transducer 39 comprising a coil 39*a* and plunger 39*b* is mechanically associated with the movably mounted, spring-biased take-off roller 8. In the event of variations in the mass of the fibre web, the displacement transducer 39 registers the distance by which the take-off roller 8 is deflected when the nip between the rollers 8, 9 changes as a result of variations in the mass of the fibre web passing through. The displacement transducer 39, as a measuring device of the control circuit, is connected to the electronic control and regulation device 36, which is in communication with individual controlled drive motors 40, 41 and 42 of, respectively, rollers I, II and III. The upper rollers 26, 27, 28 rotate together therewith.

Figure 7:
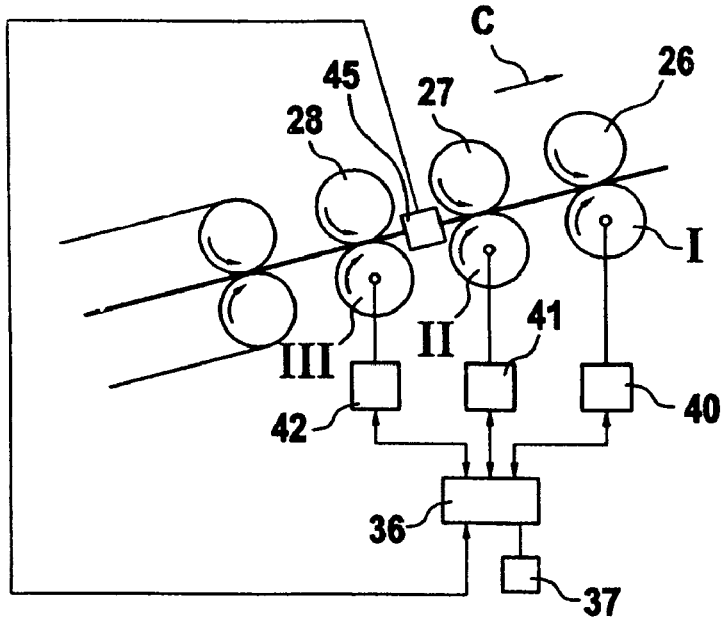
FIG. 7 shows the drawing mechanism together with a third arrangement of the control device.

In a further variant shown in FIG. 7, the measuring device 45, for example a microwave measuring arrangement, is arranged between the intake roller pair 28/III and the middle roller pair 27/II.

Figure 8:
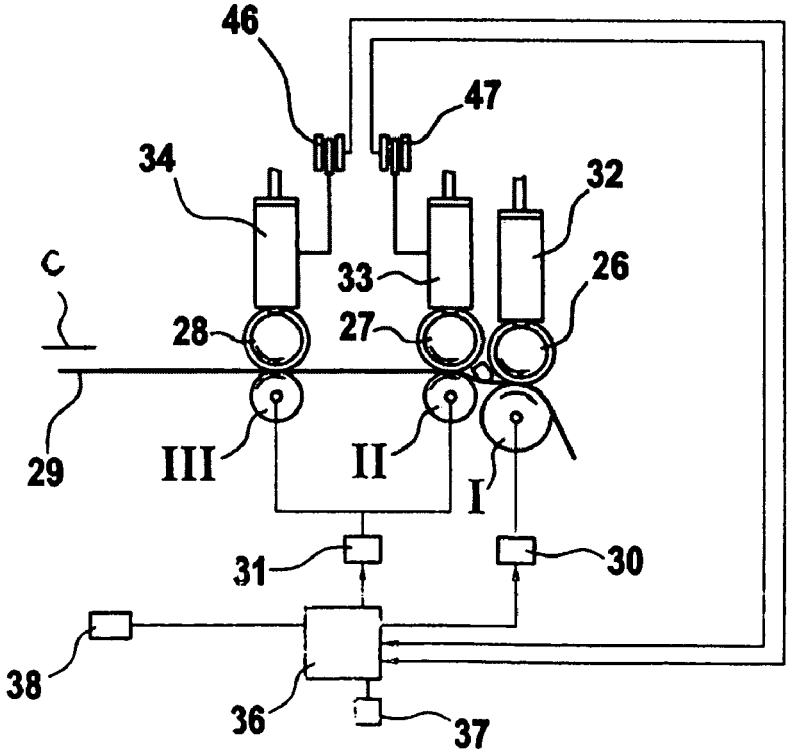
FIG. 8 shows the drawing mechanism together with a fourth arrangement of the control device.

The embodiment shown in FIG. 8, a measuring device 46 is associated with the pressure element 34 and a measuring device 47 is associated with the pressure element 33. The measuring devices 46 and 47 are, for example, inductive displacement transducers. The measuring elements 46 and 47 are connected to the control and regulation device 36, which is in communication with drive motor 30 for roller I and drive motor 31 which is arranged to drive rollers II and III.

Figure 9:
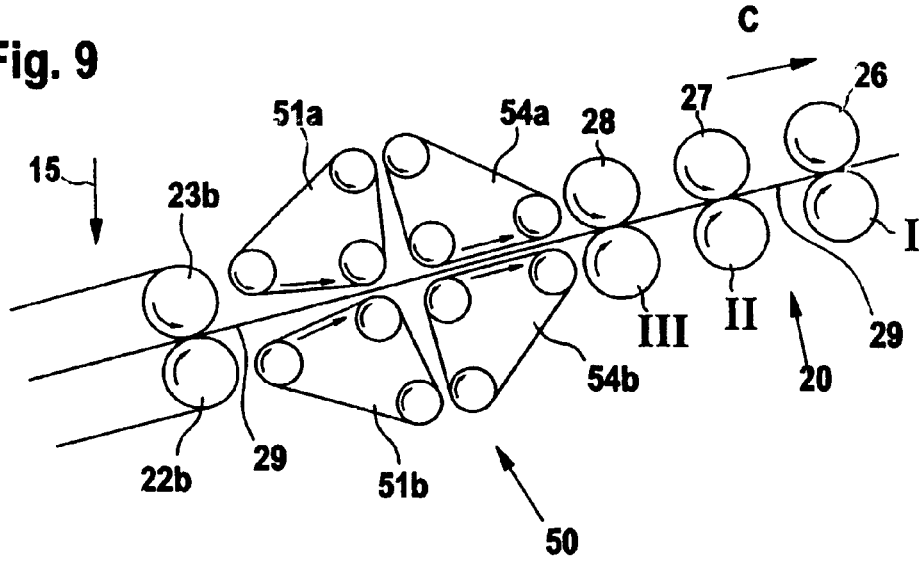
FIG. 9 shows a belt drawing mechanism between the web-guiding device and the drawing mechanism.

In the embodiment of FIG. 9, a belt drawing mechanism 50 is arranged between the return rollers 22*b*, 23*b* of the web-guiding device 15 and the intake rollers 28/III of the drawing mechanism 20. An entry part 51 consists of an upper part 51*a* and a lower part 51*b*, each of which comprises a belt 53*a* and 53*b*, respectively, revolving around three return rollers $\mathbf{52}_1$, $\mathbf{52}_2$, $\mathbf{52}_3$ and $\mathbf{52}_4$, $\mathbf{52}_5$, $\mathbf{52}_6$, respectively (see FIG. 9*a*). An exit part 54 consists of an upper part 54*a* and a lower part 54*b*, each of which comprises a belt 56*a* and 56*b*, respectively, revolving around three return rollers $\mathbf{55}_1$, $\mathbf{55}_2$, $\mathbf{55}_3$ and $\mathbf{55}_4$, $\mathbf{55}_5$, $\mathbf{55}_6$, respectively (see FIG. 9*b*). The fibre material 29 runs in direction C between the upper part 51*a* and the lower part 51*b* and between the upper part 54*a* and the lower part 54*b*.

Figure 9A:
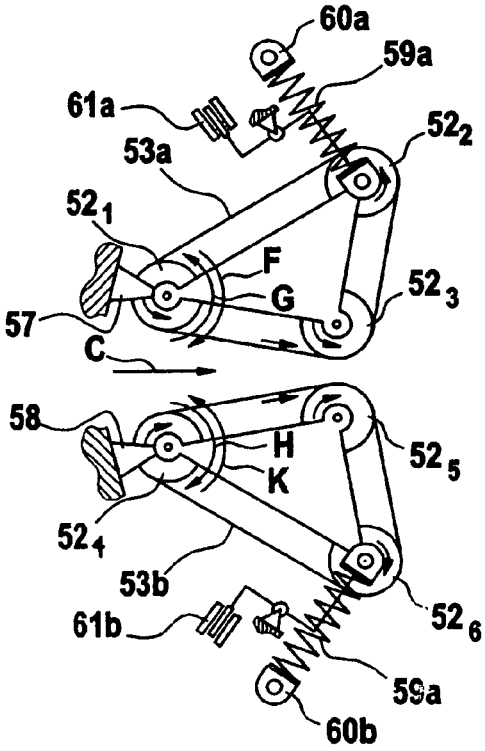
FIG. 9*a* shows, in detail, the entry part of the belt drawing mechanism.

In accordance with FIG. 9*a*, the return roller $\mathbf{52}_1$ of the upper part 51*a* is mounted in a stationary rotary mounting 57 and the return roller $\mathbf{52}_4$ of the lower part 51*b* is mounted in a stationary rotary mounting 58, as a result of which the upper part 51*a* and the lower part 51*b* can be pivoted in the direction of arrows F, G and H, K, respectively. By that means the size of the entry nip can be modified and, as a result, the precompression in the entry zone can be adjusted. The return rollers $\mathbf{52}_2$ and $\mathbf{52}_6$ are in each case mounted at one end of a resilient spring 59*a* and 59*b*, respectively, the other end of which spring is fixed to a mounting element 60*a* and 60*b*, respectively. An inductive displacement transducer 61*a* is associated with the mounting element of the return roller $\mathbf{52}_2$ and an inductive displacement transducer 61*b* is associated with the mounting element of the return roller $\mathbf{52}_6$, the transducers. being in communication with the electronic control and regulation device 36 (see FIGS. 5 to 8).

Figure 9B:
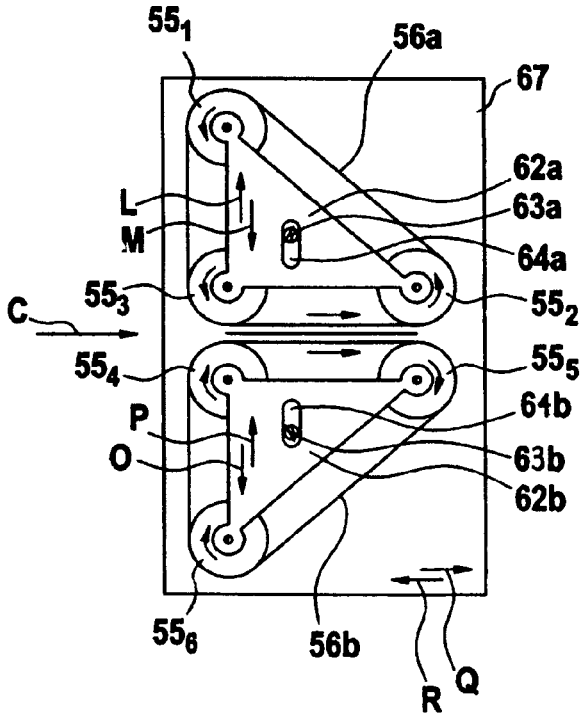
FIG. 9*b* shows, in detail, the exit part of the belt drawing mechanism.

In accordance with FIG. 9*b*, the return rollers $\mathbf{55}_1$, $\mathbf{55}_2$, $\mathbf{55}_3$ are rotatably mounted in a common holding element 62*a*, which, by means of a fastening element 63*a*, for example a bolt, is mounted in an elongate hole 64*a* in a holding element 67 so as to be displaceable in directions L, M. The return rollers $\mathbf{55}_4$, $\mathbf{55}_5$, $\mathbf{55}_6$ are rotatably mounted in a common holding element 62*b*, which, by means of a fastening element 63*b*, for example a bolt, is mounted in an elongate hole 64*b* in the holding element 67 so as to be displaceable in directions O, P. The common holding element 67, for example a plate, frame or the like, can be moved locally in the direction of arrows Q, R. As a result, the spacing between the entry part 51 and the exit part 54 can be modified.

The directions of rotation of the return rollers $\mathbf{52}_1$ to $\mathbf{52}_6$ and $\mathbf{55}_1$ to $\mathbf{55}_6$ and the revolving directions of the belts 53*a*, 53*b* and 56*a*, 56*b* are indicated by arrows in FIGS. 9, 9*a*, 9*b*. The equivalent applies to FIGS. 10 to 12.

Figure 10:
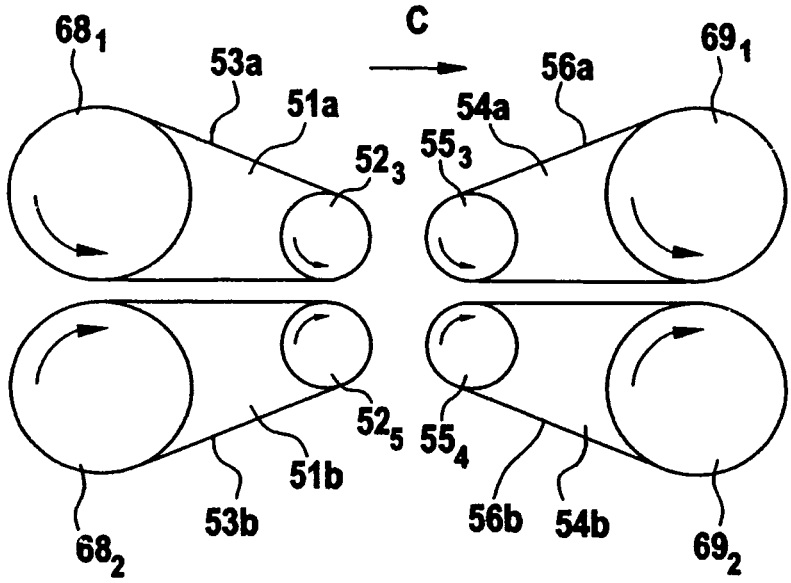
FIG. 10 shows an arrangement of the upper and lower parts, in each case having two return rollers.

In accordance with FIG. 10, according to a further embodiment, the upper part 51*a* and the lower part 51*b* of the entry part 51 and the upper part 54*a* and the lower part 54*b* of the exit part 54 each comprise a small return roller $\mathbf{52}_3$, $\mathbf{52}_5$ and $\mathbf{55}_3$, $\mathbf{55}_4$, respectively, and a large return roller $\mathbf{68}_1$, $\mathbf{68}_2$ and $\mathbf{69}_1$, $\mathbf{69}_2$, respectively, around which the belts 53*a*, 53*b* and 56*a*, 56*b*, respectively, revolve.

In respect of the rotation capability, mountings and fixings, the arrangement according to FIG. 10 can be constructed in corresponding manner to the arrangements shown in FIGS. 9, 9*a*, 9*b*.

Figure 11:
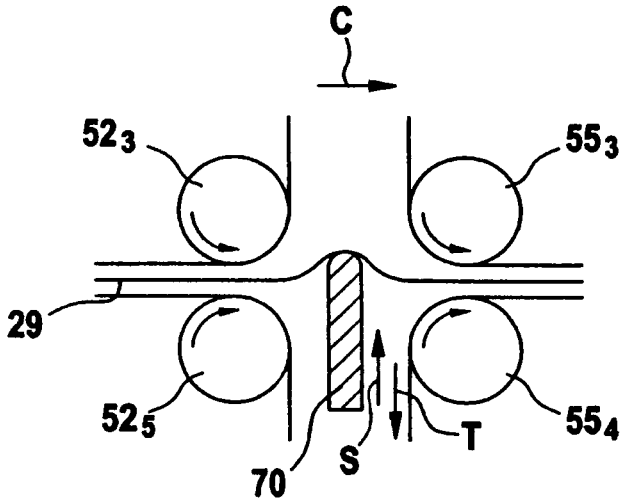
FIG. 11 shows an adjustable pressure element between the entry part and the exit part.
Figure 12:
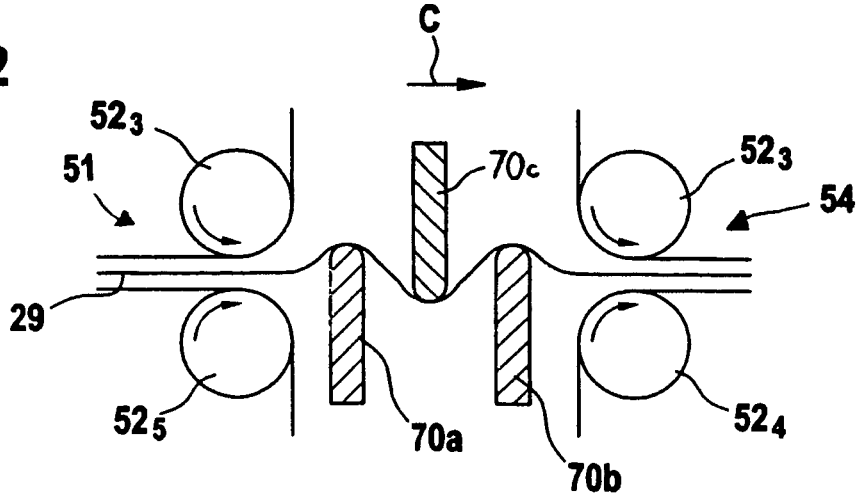
FIG. 12 shows three pressure elements between the entry part and the exit part.

In accordance with FIGS. 11 and 12, a pressure element 70 (FIG. 11) or, for example, three pressure elements 70*a*, 70*b*, 70*c* (FIG. 12) can be arranged in the gap between the entry part 51 and the exit part 54, by means of which pressure elements the fibre material 29 can be deflected upwards or downwards, that is to say pressure can be directed perpendicular to running direction C. The pressure elements 70, 70*a* to 70*c* can be arranged to be movable in the direction of arrows S, T (FIG. 11). By that means it is possible to obtain a change in the length of the fibre material 29. The pressure elements 70, 70*a* to 70*c* can also have an arrangement which is a mirror reflection of the arrangements shown in FIGS. 11 and 12.

The device according to the invention can be used advantageously for consolidating a plurality of web strips, in which case, for example, four carding machines are provided upstream of a drawing mechanism 20. The drawing mechanism, which acts as a consolidating device (compression unit), evens out variations in weight which occur in the web strips emerging individually from the plurality of carding machines provided upstream. The apparatus at a (at least one) web strip carding machine advantageously makes it possible for variations in web strip weight to be evened out.

Although the foregoing invention has been described in detail by way of illustration and example for purposes of understanding, it will be obvious that changes and modifications may be practiced within the scope of the appended claims.

What is claimed is:

1. An apparatus for consolidating a conveyable fibre web in a carding machine, comprising:

a web funnel for receiving a web of fibre material;

take-off rollers for taking-off fibre material from the web funnel;

a consolidating device downstream of the take-off rollers and the web funnel, wherein the consolidating device is in the form of a drawing mechanism comprising at least two roller pairs arranged one behind the other, each pair of rollers comprising an upper roller and a lower roller biased against one another, and wherein there is at least some control of the speed of rotation of the rollers; and a web-guiding device arranged between the take-off rollers and the drawing mechanism, the web-guiding device comprising two endlessly revolving conveyor belts co-operating with one another.

2. An apparatus according to claim 1, in which the drawing mechanism is a 3-over-3 drawing mechanism.

3. An apparatus according to claims 1, in which the drawing mechanism is arranged spaced away from the take-off rollers.

4. An apparatus according to claim 1, in which the upper rollers are biased against the lower rollers by means of pressure elements in pressure arms.

5. An apparatus according to claim 4, in which the force of the biasing pressure is adjustable.

6. An apparatus according to claim 1, in which a regulating device, which comprises a measuring device for the mass of the fibre web, an electronic control device and an actuating device, is associated with the drawing mechanism.

7. An apparatus according to claim 6, in which there is a measuring device associated with the take-off rollers.

8. An apparatus according to claim 6, comprising, as a measuring device, a displacement sensor.

9. An apparatus according to claim 6, comprising, as a measuring device, an inductive sensor.

10. An apparatus according to claim 6, comprising, as a measuring device, a capacitive sensor.

11. An apparatus according to claim 6, comprising, as a measuring device, a microwave sensor.

12. An apparatus according to claim 6, in which the measuring device is arranged between the take-off rollers and the entrance to the drawing mechanism.

13. An apparatus according to claim 6, in which the measuring device is arranged between two roller pairs of the drawing mechanism.

14. An apparatus according to claim 6, in which the measuring device is associated with at least one upper roller of the drawing mechanism.

15. An apparatus according to claim 6, in which at least one pressure rod is provided in a main drafting zone of the drawing mechanism.

16. An apparatus according to claim 1, comprising an actuating device for driving at least one roller pair of the drawing mechanism, the actuating device comprising a controlled motor.

17. An apparatus according to claim 16, in which the controlled motor is capable of modifying the drafting between the roller pairs of the drawing mechanism.

18. An apparatus according to claims 1, in which intake and middle roller pairs of the drawing mechanism are arranged to be driven by a common controlled motor.

19. An apparatus according to claim 1, in which intake and middle roller pairs are each arranged to be driven by a controlled motor.

20. An apparatus according to claim 1, in which one or more controlled motors for the drawing mechanism and drive motors for the carding machine are connected to a common electronic control and regulation device.

21. An apparatus according to claim 1, in which the web-guiding means is capable of diverting the fibre web from a first direction on exit from the take-off rollers to a second direction for entry to the drawing mechanism.

22. An apparatus according to claim 1, in which the speed of at least one of the roller pairs is subject to closed-loop control.

23. An apparatus according to claim 1, wherein the apparatus is arranged to receive fibre material from at least two carding machines provided upstream of the consolidating device.

24. An apparatus according to claim 23, in which at least two web strips are brought together and introduced into the consolidating device.

25. An apparatus according to claim 23, in which at least two web strips are arranged one above the other.

26. Apparatus according to claim 1, wherein a belt drawing mechanism is arranged between the web-guiding device and the drawing mechanism.

27. Apparatus according to claims 26, wherein the belt drawing mechanism comprises an entry part and an exit part.

28. Apparatus according to claim 27, wherein an upper part of the entry part and a lower part of the entry part are arranged to be rotatable about rotary mountings.

29. Apparatus according to claim 28, wherein a first spring element is associated with the upper part and a second spring element is associated with the lower part.

30. Apparatus according to claim 29, wherein a first inductive displacement transducer is associated with the upper part and a second inductive displacement transducer is associated with the lower part.

31. Apparatus according to claim 30, wherein for the return rollers an upper part of the exit part has a first holding element and lower part of the exit part has a second holding element.

32. Apparatus according to claim 31, wherein the upper part of the exit part is displaceably mounted, and the lower part of the exit part is displaceably mounted, on a holding device.

33. Apparatus according to claim 32, wherein the holding device is displaceable.

34. Apparatus according to claim 27, wherein the entry and exit parts each comprise upper and lower parts that each have a belt revolving around three return rollers.

35. Apparatus according to claim 27, wherein the entry and exit parts each comprise upper and lower parts that each have a belt revolving around two return rollers.

36. Apparatus according to claim 27, wherein between the entry part and the exit part there is provided at least one pressure element for the fibre material.

37. Apparatus according to claim 36, wherein at least one pressure element is arranged to be displaceable.

38. Apparatus according to claim 37, wherein the at least one displaceable pressure element is capable of deflecting the fibre material perpendicular to its running direction.

39. An apparatus for consolidating a conveyable fibre web, comprising:

a web funnel together with take-off rollers provided at the exit from a flat card or a roller card, wherein the outlet region of the web funnel has a substantially rectangular cross-section, a web-guiding device arranged downstream of the web funnel, the web-guiding device comprising two endlessly revolving conveyor belts co-operating with one another, and an endlessly revolving consolidating device provided downstream of the web funnel and the web-guiding device, wherein the consolidating device comprises at least two roller pairs, between which the fibre web passes, the at least two roller pairs arranged one behind the other, each of the at least two roller pairs including an upper roller and a lower roller biased by a force against one another, and wherein there is at least some control of the speed of rotation of the rollers.

* * * * *